United States Patent [19]

Schmid

[11] Patent Number: 4,993,118

[45] Date of Patent: Feb. 19, 1991

[54] CLEANING MACHINE FOR TEXTILE FIBRES HAVING IMPROVED GRATE BAR ARRANGEMENT

[75] Inventor: René Schmid, Niederneunforn, Switzerland

[73] Assignee: Maschinenfabrik Rieter AG, Winterthur, Switzerland

[21] Appl. No.: 471,515

[22] Filed: Jan. 29, 1990

[30] Foreign Application Priority Data

Jan. 31, 1989 [CH] Switzerland ..... 321/89-0

[51] Int. Cl.[5] ..... D01G 9/14

[52] U.S. Cl. ..... 19/85; 19/95

[58] Field of Search ..... 19/55 R, 43, 62 R, 85, 19/95, 200, 205

[56] References Cited

U.S. PATENT DOCUMENTS

| | | | |
|---|---|---|---|
| 367,914 | 8/1887 | Keene | 19/95 |
| 540,570 | 6/1895 | Arnfield | 19/95 |
| 630,022 | 8/1899 | Atherton | 19/95 |
| 641,060 | 1/1900 | Wilde | 19/95 |
| 735,076 | 8/1903 | Evans | 19/95 |
| 1,530,286 | 3/1925 | Armstrong . | |
| 2,034,664 | 3/1936 | Moss | 19/95 |
| 2,127,049 | 8/1938 | Schwarze et al. | 19/95 |
| 2,836,858 | 6/1958 | Szaloki | 19/95 |
| 4,426,753 | 1/1984 | Oellers et al. | 19/85 |

FOREIGN PATENT DOCUMENTS

| | | | |
|---|---|---|---|
| 3333618 | 4/1985 | Fed. Rep. of Germany . | |
| 1284843 | 1/1962 | France . | |
| 1148912 | 4/1985 | U.S.S.R. | 19/85 |
| 2053995 | 2/1981 | United Kingdom . | |

*Primary Examiner*—Werner H. Schroeder
*Assistant Examiner*—John J. Calvert
*Attorney, Agent, or Firm*—Burns, Doane, Swecker & Mathis

[57] ABSTRACT

A machine for cleaning textile fibres including a casing, a horizontal opening roller rotatably mounted in the casing, the roller being fitted with beater elements and at least one group of grate bars arranged below the underside and approximately parallel to the opening roller. Textile fibres in the form of flocks are fed to the opening roller in a current of delivery air through an inlet located above and at one end of the opening roller. An outlet for removing the delivery air is arranged above and at the other end of the opening roller. A clearance between the grate bars and the opening roller is adjustable. Therewith, the machine can be optimally suited to the type of textile fibre material to be cleaned. The grate bars can also be further adjustable on a axis parallel to their own longitudinal axis, so that the setting angle of the grate bars, with reference to the current of delivery air, can also be adapted to the type of the textile fibre material.

16 Claims, 2 Drawing Sheets

CLEANING MACHINE FOR TEXTILE FIBRES HAVING IMPROVED GRATE BAR ARRANGEMENT

FIELD OF THE INVENTION

The invention relates to a cleaning machine for textile fibers transported in a current of delivery air, the machine including a horizontal opening roller fitted with beater elements and below the underside of the roller, adjustable grate bars are arranged which are adjustable in their setting angle.

BACKGROUND

A cleaning machine of the above type is known and obtainable on the market and it is also known that the grate bars, as a rule profile rods, with the object of altering their setting angle, are made capable of swiveling on their longitudinal parallel axes in order to make the adjustment to different fiber materials possible. This known adjustment possibility, however, only permits the same adjustment for all grate bars, that is, in a relatively limited range.

SUMMARY OF THE INVENTION

An object of the invention is to provide a cleaning machine of the above type but in which an improved adjustment is possible to suit different textile fiber materials in a wider range of characteristics.

The above object can be fulfilled according to the invention by providing at least some of the grate bars such that they are adjustable with respect to the roller, in order to alter the clearance between the grate bars and the roller.

Another object of the invention is to provide an arrangement wherein the grate bars can swivel to different amounts with respect to each other on an axis parallel to their own longitudinal axis.

A further object of the invention is to provide an arrangement wherein the two axial ends of the grate bars can be adjusted to different distances with reference to the opening roller.

According to the present invention, it is possible to provide a group of grate bars lying adjacent to each other in the circumferential direction of the roller, the grate bars at one end of the group (viewed in the circumferential direction) being adjustable to different distances with reference to the roller and if necessary, swivel differently compared to the grate bars at the other end of the group.

BRIEF DESCRIPTION OF THE DRAWINGS

An example of the cleaning machine according to the invention is explained in more detail with the aid of the accompanying drawings, in which.

DETAILED DESCRIPTION OF THE PREFERRED EMBODIMENTS

Figure 1:
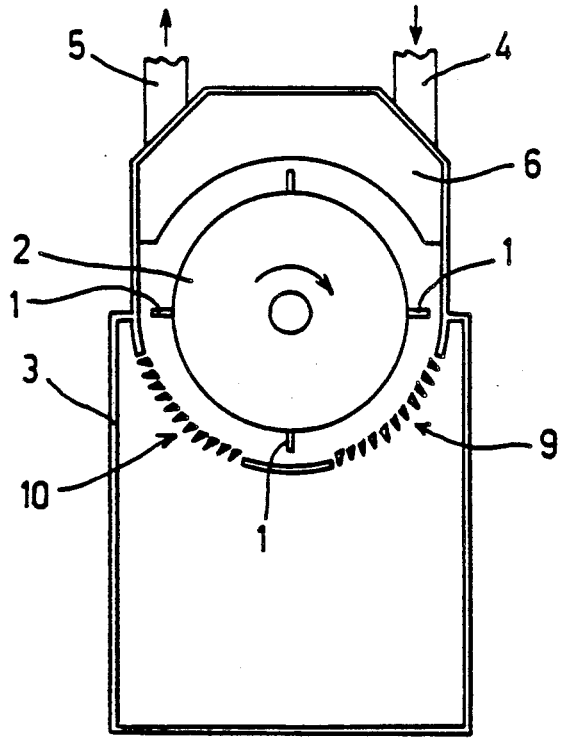
FIG. 1 shows a schematic vertical section through a cleaning machine for textile fibers according to the invention.

The cleaning machine shown in FIGS. 1–4 has an opening roller 2 fitted with beater rods 1 and is supported to rotate on a horizontal axis in a casing 3. In operation, the opening roller 2 is rotated in the direction of the arrow according to FIG. 1 by a driving motor which is not shown. Above the upper side of the opening roller 2, the casing 3 has an inlet 4 and an outlet 5 for textile fibers in the form of flocks transported in a current of delivery air. The inlet 4 is arranged at one end of the roller 2, whilst the outlet 5 is arranged at the other end of the roller 2. On the upper side of the opening roller 2 and between the inlet 4 and the outlet 5, three deflectors 6, 7, 8 are arranged inclined to the axis of the roller so as to define two transfer chambers between the upper side of the roller 2 and the upper wall of the casing 3.

Figure 2:
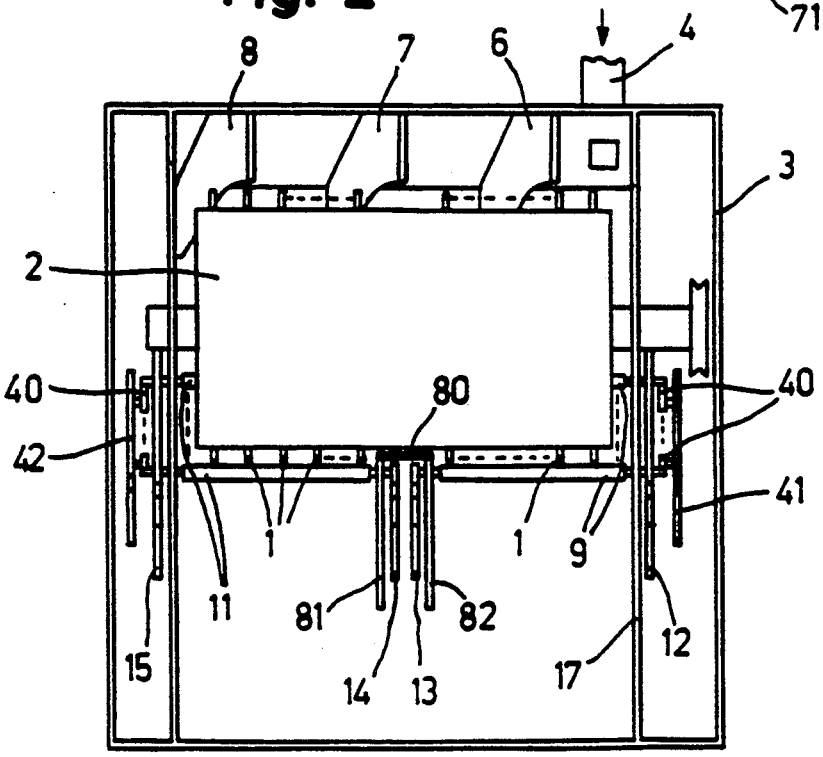
FIG. 2 shows a vertical section through the machine shown in FIG. 1.

Bar grates are arranged below the underside of the opening roller 2 and include grate bars which are approximately parallel to the roller. Preferably, as shown in FIG. 1, there are two groups of grate bars 9 and 10 arranged one behind the other in the circumferential direction of the opening roller. The first and the last grate bar of the group 9 are also shown in FIG. 2, from which it can further be seen that, a third group of grate bars 11 is arranged in the direction of the axis of the roller 2, adjacent to the group of grate bars 9. In the same way, a fourth group Z of grate bars (not shown) lies in the direction of the axis of the roller 2, adjacent to the group of grate bars 10.

In operation, textile fibers to be cleaned and opened are conveyed through the inlet 4 in a current of delivery air. The delivery air with the fiber flocks next streams substantially around the underside of the rotating opening roller 2, then through the transfer chamber between the deflectors 6 and 7, which moves the air further in the axial direction of the opening roller 2, then again around the underside of the roller, then through the transfer chamber between the deflectors 7 and 8, and again around the underside of the roller, in order to leave the machine finally through the outlet 5. The fiber flocks are processed by the beater rods 1 with the circulation around the underside of the roller 2 and progressively opened during a stroking and beating process, so that impurities are separated through the four groups of grate bars 9, 10, 11, Z and sucked from the space under the grate bars by a suction device, not shown, which does not affect the current of delivery air.

The four groups of grate bars 9, 10, 11, Z (the group which is not shown), are preferably adjustable independently of each other with reference to the opening roller 2, respectively, with reference to the frame of the machine, in order to alter the clearance between the grate bars and the roller 2.

Preferably, in each of the four groups 9, 10, 11, Z, both axial ends of the grate bars are independently adjustable with reference to distances between the grate bars and the roller 2, and further, the two circumferential ends of each of the groups 9, 10, 11, Z extending in the circumferential direction of the roller 2 can both be likewise independently adjusted. For this purpose, a common, adjustable clearance controlling element is in contact with each axial end of each group of grate bars 9, 10, 11, Z, that is, both ends of the grate bars of each group are each in contact with a respective common, adjustable clearance controlling element.

As shown in FIG. 2, the right hand axial ends of the grate bars 9 are in contact with a clearance control template 12, whilst the left hand axial ends of the grate bars 9 are in contact with a clearance control template 13. The right hand axial ends of the grate bars 11 are in contact with a clearance control template 14, and the left hand axial ends of the grate bars 11 are in contact with a clearance control template 15. The clearance control template 12 and a further clearance control template 16, which is allocated to the group of grate bars 10 (FIG. 1), are also shown in FIG. 3.

The axial ends 9.1 of the grate bars 9 rest in holes in the template 12. Preferably, these holes, as indicated at the end 9.1 of the circumferentially outermost grate bar 9, are oblong holes, which are extended in the direction of the roller 2 and the ends 9.1 are further guided in radially extended oblong holes (not shown) and guided in a bearing plate 17 (FIG. 2) of the machine frame. The template 12 is variously adjustable with reference to the machine frame through two adjustment devices which can be activated independently of each other, which reach to the template in the area of the ends 9.1 of the circumferentially innermost and the outermost grate bars 9, respectively. These adjustable devices can be of any desired type.

Figure 3:
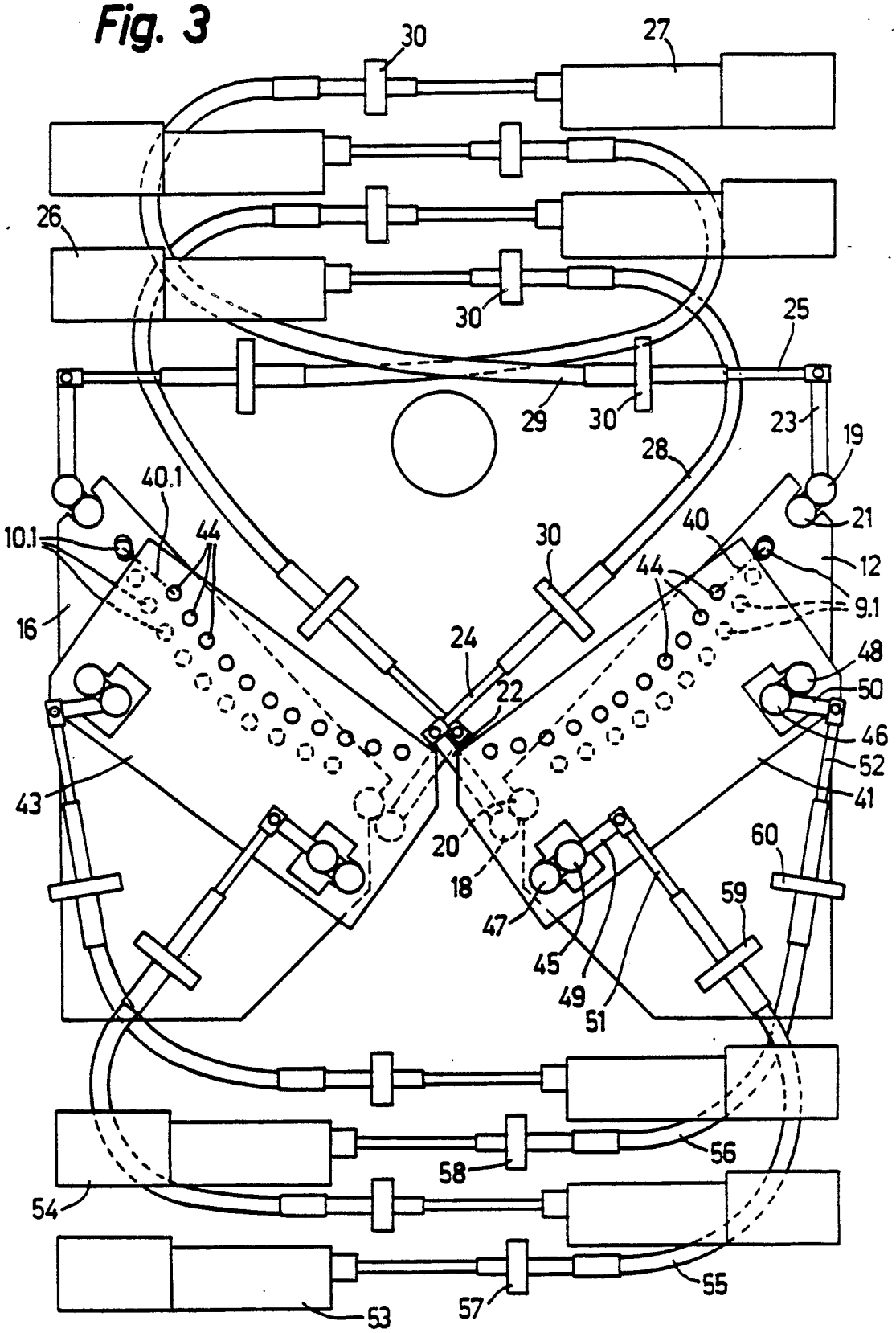
FIG. 3 shows a partial lateral view to a larger scale of the machine shown in FIG. 2, without the outer casing wall.

For example, as shown in FIG. 3, each of the adjustment devices can include a doubled armed lever, which can be swivelled on a rigid (stationary) axis 18 or 19, respectively, on the machine frame. One arm 20 and 21, respectively, of each of these levers reaches in each case into a recess in the template 12, whilst the other arm, 22 and 23, respectively, of each of these levers is fitted to one end of a Bowden control cable 24 and 25, respectively, the other end of which is actuated by a linear motor 26 and 27, respectively, arranged rigidly on the frame. A conduit 28 and 29, respectively, of the Bowden control cable is anchored at both ends on a fastener 30 mounted rigidly on the frame.

A movable template, formed like the template 12, is allocated to each end of the groups of grate bars 9, 10, 11, Z.

Figure 4:
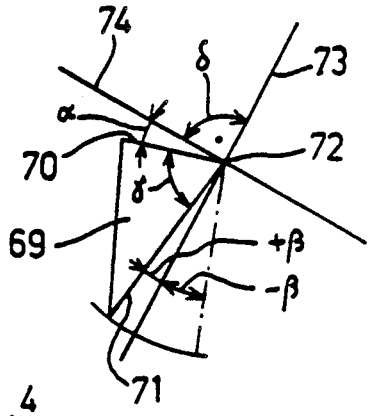
FIG. 4 shows a detail of the machine shown in FIG. 1, but in an enlarged representation.

The grate bars, which are as a rule, formed approximately as triangular profiles, for example, are in the cleaning machine according to the invention, preferably each arranged to swivel on an axis parallel to their own longitudinal axis, so that a setting angle beta ($\beta$), as shown in FIG. 4, of the grate bars can be altered with reference to the current of delivery air passing around the opening roller 2. A swivel device can be allocated to each of the four groups of grate bars 9, 10, 11, Z and this can preferably be so developed that it can swivel each of the grate bars 9, 10, 11, Z to a different extent at locations spaced apart in the circumferential direction of the roller 2.

The setting angle $\beta$ of the grate bars can increase or decrease gradually within the group in the circumferential direction of the roller 2. In the example shown, the grate bars of every group 9, 10, 11, Z each have a crank arm 40 on one end which is swivelled on a common angle control element. In this way, the crank arms 40 of the group of grate bars 9 according to FIG. 2 are linked on an angle control template 41 and the crank arms 40 of the group of grate bars 11 are swivelled on an angle control template 42. The template 41 and a further angle control template 43, which is allocated to the group of grate bars 10 (FIG. 1) are also shown in FIG. 3, in which the crank arms associated with grate bars 10 are designated with 40.1. For the sake of simplicity, only one crank arm 40 and 40.1, respectively, on one end 9.1 or 10.1, respectively, of the circumferentially outermost grate bar of the group of grate bars 9 or 10, respectively, in FIG. 3 is represented by a dash dotted line.

The template 41 and 43, respectively, carries a row of pins 44, which supports the crank arms 40 and 40.1, respectively, of the group of grate bars 9 and 10, respectively. The template 41 is adjustable with reference to the clearance control template 12 through two adjustment devices which can be activated independently of each other, which reach to the template 41. These adjustable devices can also be of any desired type. For instance, in the example shown, each again has a doubled armed lever, which can be swivelled on a rigid (stationary) axis 45 and 46, respectively, carried on the template 12. One arm 47 and 48, respectively, of each of these levers reaches to an opening in the template 41, whilst on the other arm 49 and 50, respectively, of each of these levers, a Bowden control cable 51 and 52, respectively, is fitted, the other end of which is actuated by a linear motor 53 and 54, respectively, arranged rigidly on the frame. The conduits 55 and 56, respectively, of the Bowden control cables are anchored adjacent to the linear motor 53 and 54, respectively, on a fastener 57 or 58, respectively, and at the other end on a fastener 59 and 60, respectively, on the template 12.

FIG. 4 shows a single grate bar of the groups 9, 10, 11, Z to a larger scale, with a free area 70, a setting area 71, and a wedge angle gamma ($\gamma$) which is formed by the free area 70 and the setting area 71, the section line of which forms further a cutting edge 72. Further, the setting angle beta ($\beta$) previously mentioned is formed between the setting area 71 and an imaginary plane 73 which contains the cutting edge 72 and the axis of the roller 2 (not shown), whilst the free angle alpha ($\alpha$) is formed between the free area 70 and an imaginary plane 74 containing the cutting edge 72. Thereby, the tangential plane 74 forms a right angle delta ($\delta$) with the radial plane 73.

The free angle alpha ($\alpha$) is adjustable between zero and 30°. The setting angle beta ($\beta$) is selected empirically according to the product at the time. The setting angle beta ($\beta$) can have a negative or positive value, as can be seen from FIG. 4, according to the selection of the wedge angle gamma ($\gamma$) in connection with the selection of the free angle alpha ($\alpha$). However, a positive angle is preferable.

The adjustment possibilities previously mentioned regarding the clearances of the grate bars 69 to the roller 2 and the setting angles beta, bring the advantage that the clearances and setting angles can be differently selected per grate bar group 9, 10, 11, Z and within the group, so that a greater variation with reference to the technological effect, that is, cleaning effect, fiber protection, prevention of new formation etc, can be achieved according to the product processed.

When a machine is selected which does not operate as shown in FIG. 2 with four grate groups but simply with two, then it is possible, with continuous throughgoing grate bars and the use of the clearance control templates analogous to 12 and 15, to select the clearances to the roller 2 differently on both ends of the grate bars 2, seen in the axial direction of the roller, which likewise makes the technological effect variable in the direction of the axis.

Finally, it has still to be stated that a cover 80 covers the clearance control templates 13 and 14, in the mid-area of the machine, as shown in FIG. 2, as well as directly left, seen from FIG. 2, the control template 14 and, arranged on the right of the control template 13, the hearing plates 81 or 82, respectively, accepting the grate bars cover in such a way that no air-flocks mixture can fall between the bearing plates 81 and 82.

With the arrangement of the present invention, a number of adjustments with respect to the individual groups of bars are possible. For instance, a first distance between a first group of bars 9 and the roller 2 can be different than a second distance between a second group of bars 10 and the roller 2. Likewise, a third distance between a third group of bars 11 and the roller 2 can be different than the first and/or the second distances. Similarly, a fourth distance between a fourth group of bars Z and the roller 2 can be different from the first and/or second and/or third distances.

Another possibility with the arrangement according to the present invention is that the distances between the roller 2 and various bars of a particular group of bars 9, 10, 11 or Z can be equal to each other or be different from each other. For instance, with respect to the direction of travel of the delivery air around the roller 2, the upstream bars of an individual group of bars can be located closer to or further away from the roller 2 than downstream bars of the same group.

Another possibility with the arrangement according to the present invention is that the setting angle of the bars of one group of bars can be made different from the setting angle of a different group of bars. For instance, the group of bars 9 can have a setting angle which differs from the circumferentially adjacent group of bars 10 and/or the group of bars 9 can have a setting angle which differs from the axially adjacent group of bars 11. Likewise, the group of bars 9 can have a setting angle which differs from the group of bars Z circumferentially adjacent to the group of bars 11. In the same manner, the group of bars 10 can have a setting angle which differs from that of the group of bars 11 and/or the group of bars Z and the group of bars 11 can have a setting angle which differs from that of the group of bars Z.

In the case where the machine of the present invention includes two groups of grate bars, rather than four groups of grate bars, the provision of clearance control templates at each axial end of each group of bars allows the clearance between the bars and the roller 2 to be different at each axial end of the roller. For instance, if the group of bars 9 and the group of bars 11 are combined into a single group of bars and the axial ends of the bars are supported by the clearance control templates 12 and 15, respectively, the portions of the bars located closer to the template 12 can be located closer to or further from the roller 2 than the portions of the bars located closer to the template 15.

While the invention has been described with reference to the foregoing embodiments, changes and modifications may be made thereto which fall within the scope of the appended claims.

What is claimed is:

1. A cleaning machine for textile fibers transported in a current of delivery air, comprising a casing, a horizontal opening roller rotatably mounted in the casing, the roller being fitted with beater elements and below the underside of the roller at least one discrete group of adjacent approximately parallel grate bars being arranged so as to be adjustable with respect to a setting angle of each of the grate bars, the group of the grate bars being adjustable with reference to the opening roller in order to alter a clearance between the group of grate bars and the opening roller, the group of grate bars being supported by swivel means for swiveling each of the grate bars such that the setting angle of each of the grate bars can be simultaneously increased or decreased individually within the group of the grate bars in a circumferential direction of rotation of the opening roller.

2. The cleaning machine according to claim 1, wherein opposite ends of the grate bars are adjustable independently of each other with reference to the opening roller.

3. The cleaning machine according to claim 1, wherein at least some of the ends of the grate bars are in contact with an approximately radially adjustable common clearance control element with reference to the opening roller.

4. The cleaning machine according to claim 3, wherein the clearance control element can be differently adjusted through two independently activated adjustment devices.

5. The cleaning machine according to claim 1, wherein first ends of the grate bars are in contact with a first approximately radially adjustable clearance control element with reference to the opening roller and second ends of the grate bars are in contact with a second approximately radially adjustable clearance control element.

6. The cleaning machine according to claim 5, wherein the first and second clearance control elements are adjustable independently of each other.

7. A cleaning machine for textile fibers transported in a current of delivery air, comprising a casing, a horizontal opening roller rotatably mounted in the casing, the roller being fitted with beater elements and below the underside of the roller at least one group of approximately parallel grate bars being arranged which are adjustable in their setting angle, at least some of the grate bars being adjustable towards and away with reference to the opening roller in order to alter a clearance between the grate bars and the opening roller, said at least one group of grate bars comprising at least two discrete groups of grate bars, each of said two groups being adjustable independently of each other and arranged one behind the other in a circumferential direction extending about an axis of rotation of the opening roller.

8. A cleaning machine for textile fibers transported in a current of delivery air, comprising a casing, a horizontal opening roller rotatably mounted n the casing, the roller being fitted with beater elements and below the underside of the roller at least one group of approximately parallel grate bars being arranged which are adjustable in their setting angle, at least some of the grate bars being adjustable with reference to the opening roller in order to alter a clearance between the grate bars and the opening roller, said at least one group of grate bars comprising at least two discrete groups of grate bars, each of said two groups being adjustable independently of each other and arranged next to each other in an axial direction parallel to an axis of rotation of the opening roller.

9. A cleaning machine for textile fibers transported in a current of delivery air, comprising a casing, a horizontal opening roller rotatably mounted in the casing, the roller being fitted with beater elements nd below the underside of the roller at least one group of approximately parallel grate bars being arranged which are adjustable in their setting angle, at least some of the grate bars being adjustable towards and away with reference to the opening roller in order to alter a clearance between the grate bars and the opening roller, said at least one group of grate bars comprising four discrete groups of grate bars, each of said four groups being adjustable independently of each other.

10. THe cleaning machine according to claim 1, wherein at least some of the grate bars can swivel to varying amounts with respect to each other on an axis parallel to a longitudinal axis thereof.

11. The cleaning machine according to claim 3, wherein each of the grate bars of a first group of the at least one group of grate bars swivels on an axis parallel to a longitudinal axis of the respective grate bar.

12. A cleaning machine for textile fibers transported in a current of delivery air, comprising a casing, a horizontal opening roller rotatably mounted in the casing, the roller being fitted with beater elements a below the underside of the roller at least one group of approximately parallel grate bars being arranged which are adjustable in their setting angle, at least some of the grate bars being adjustable towards and away with reference to the opening roller in order to alter a clearance between the grate bars and the opening roller, at least some of the ends of the grate bars being in contact with an approximately radially adjustable common clearance control element with reference to the opening roller, each of the grate bars of a first group of the at least one group of grate bars swiveling on an axis parallel to a longitudinal axis thereof, each of the grate bars of the first group of grate bars carrying a crank arm which is linked to a common angle control element at any given time, the common angle control element being adjustable with reference to the clearance control element allocated to the first group.

13. The cleaning machine according to claim 12, wherein the angle control element can be differentially adjusted with reference to the clearance control element through two independently activated adjustment devices.

14. The cleaning machine according to claim 2, wherein opposite ends of the grate bars are adjustable independently of each other with respect to the clearance between the grate bars and the opening roller.

15. A cleaning machine for textile fibers transported in a current of delivery air, comprising a casing, a horizontal opening roller rotatably mounted in the casing, the roller being fitted with beater elements and below the underside of the roller at leas one group of approximately parallel grate bars being arranged which are adjustable in their setting angle, at least some of the grate bars being adjustable towards and away with reference to the opening roller in order to alter a clearance between the grate bars an the opening roller, the grate bars being arranged in at least first and second discrete groups, the grate bars of the first group being adjustable in their setting angle independently of the grate bars of the second group.

16. The cleaning machine according to claim 1, wherein clearances between the opening roller and first axial ends of at least some of the grate bars located at one end of the opening roller are adjustable such that some of the first axial ends are closer to the opening roller than others of the first axial ends.

* * * * *